United States Patent [19]

Sherwood

[11] 4,164,011

[45] Aug. 7, 1979

[54] DECORATIVE DROP CEILING

[75] Inventor: Edward F. Sherwood, Gettysburg, Pa.

[73] Assignee: Westinghouse Electric Corp., Pittsburgh, Pa.

[21] Appl. No.: 850,564

[22] Filed: Nov. 11, 1977

[51] Int. Cl.[2] ..... F21V 21/00; F21V 21/04; F21S 1/02; F21S 1/14; F21S 3/02; F21S 3/14; F21V 5/04; F21V 17/00

[52] U.S. Cl. ..... 362/148; 52/28; 362/330; 362/331; 362/365; 362/367; 362/404; 362/408; 362/455; 362/456; 362/806

[58] Field of Search ..... 52/28, 39; 362/147–150, 330–331, 364–367, 404, 408, 455, 456, 806

[56] References Cited

U.S. PATENT DOCUMENTS

| | | | |
|---|---|---|---|
| 2,165,835 | 7/1939 | Brady et al. | 362/456 |
| 2,289,904 | 7/1942 | Curtis | 362/456 |
| 2,334,484 | 11/1943 | Dunbar | 52/28 |
| 2,398,507 | 4/1946 | Rolph | 362/148 |
| 2,689,026 | 9/1954 | Zingone | 362/148 |
| 3,018,083 | 1/1962 | Bobrick | 362/365 |
| 3,076,890 | 2/1963 | Guth, Jr. | 362/806 |
| 3,130,922 | 4/1964 | Smith | 362/148 |
| 3,268,721 | 8/1966 | Dworkin et al. | 362/364 |
| 3,721,050 | 3/1971 | Perina | 52/28 |
| 3,755,667 | 8/1973 | Price | 362/147 |

*Primary Examiner*—Benjamin R. Padgett
*Assistant Examiner*—T. S. Gron
*Attorney, Agent, or Firm*—D. R. Lackey

[57] ABSTRACT

A decorative drop ceiling including a panel having a plurality of openings therein disposed between a source of light and an area to be illuminated. A light transmissive lens is disposed in each of the openings. Each lens has a predetermined thickness dimension, which is not dictated by the thickness of the panel. The lower face of each lens is co-planar with the lower surface of the panel. The periphery of the lens is recessed, and fasteners, disposed in the recess, fix the lens in the opening.

9 Claims, 8 Drawing Figures

DECORATIVE DROP CEILING

BACKGROUND OF THE INVENTION

1. Field of the Invention

The invention relates in general to illuminated ceiling structures, and more specifically to decorative drop ceiling structures which include light transmissive lenses.

2. Description of the Prior Art

Certain types of drop ceiling structures include an opaque panel disposed between a source of light and area to be illuminated. The panel includes a plurality of light transmissive lenses disposed in openings formed in the panel. The lenses may be round, square, or any other desired configuration, and the opaque panel may be wood, plastic, or the like, of any one of a plurality of different thickness dimensions. For purposes of appearance, each lens must appear to snugly fit its associated opening, and when viewed from below, the lens must be devoid of any apparent fastening means.

The varying requirements of appearance and structure have been accommodated in the prior art by constructing each lens with a thickness dimension which exceeds the thickness dimension of the opaque panel. The diameter of the lens is also selected to exceed the diameter of the opening. A portion of the outer periphery of the lens is then machined to provide a second diameter portion sized to snugly enter the opening. The shoulder formed on the outer periphery of the lens between the starting diameter and the second diameter rests on the top surface of the panel, to support the lens in the opening.

The usual lens is formed of a polycarbonate resin, with the starting stock being an extruded form. The thicker the lens, the greater the cost. The dimensional tolerance also increases with thickness. The relatively large manufacturing tolerances on the thicker lens cause problems when a plurality of lenses of different dimensions due to this tolerance are machined to provide the second diameter portion of the lens which must snugly fit an opening, and align the lower surface of the lens with the bottom surface of the panel.

Thus, it would be desirable to provide a new and improved illuminated drop ceiling structure which is more adaptable to the varying requirements of appearance and structure, and which is less costly to construct. Of course, the desirable objectives must be achieved without compromising the appearance of the new and improved drop ceiling structure.

SUMMARY OF THE INVENTION

Briefly, the present invention is a new and improved illuminated, drop ceiling structure which includes a panel and a plurality of lenses mounted therein. The lenses have a thickness dimension between first and second major surfaces which is not dictated by, and not necessarily greater than, the thickness dimension of the panel. The thickness dimension of the lens may be standardized, regardless of panel thickness, with the thickness of the lens in a preferred embodiment being selected to be substantially less than the normal range of panel thickness dimensions.

Each lens has its first surface disposed co-planar with the lower surface of the panel. Recesses in the periphery of each lens, which start a predetermined dimension from the first surface and extend to the second surface, provide spaces from fastener means. In a preferred embodiment of the invention, the recesses are provided by machining the lens continuously about its periphery to provide first and second different diameters which define a shoulder or step in the cross-sectional configuration of the lens. Fastener means, including a strip or tab formed of light transmissive material, is adhesively secured to the surface which defines the smaller of the first and second diameters. The strip or tab extends above the second surface of the lens, and this upstanding portion is secured to the panel. The larger of the first and second diameter portions forms a collar which snugly fits the opening, giving the appearance that the lens is the same thickness as the thickness of the panel. The fastener strips or tabs, being formed of light transmissive material, are not apparent when the ceiling is viewed from below.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Figure 1:
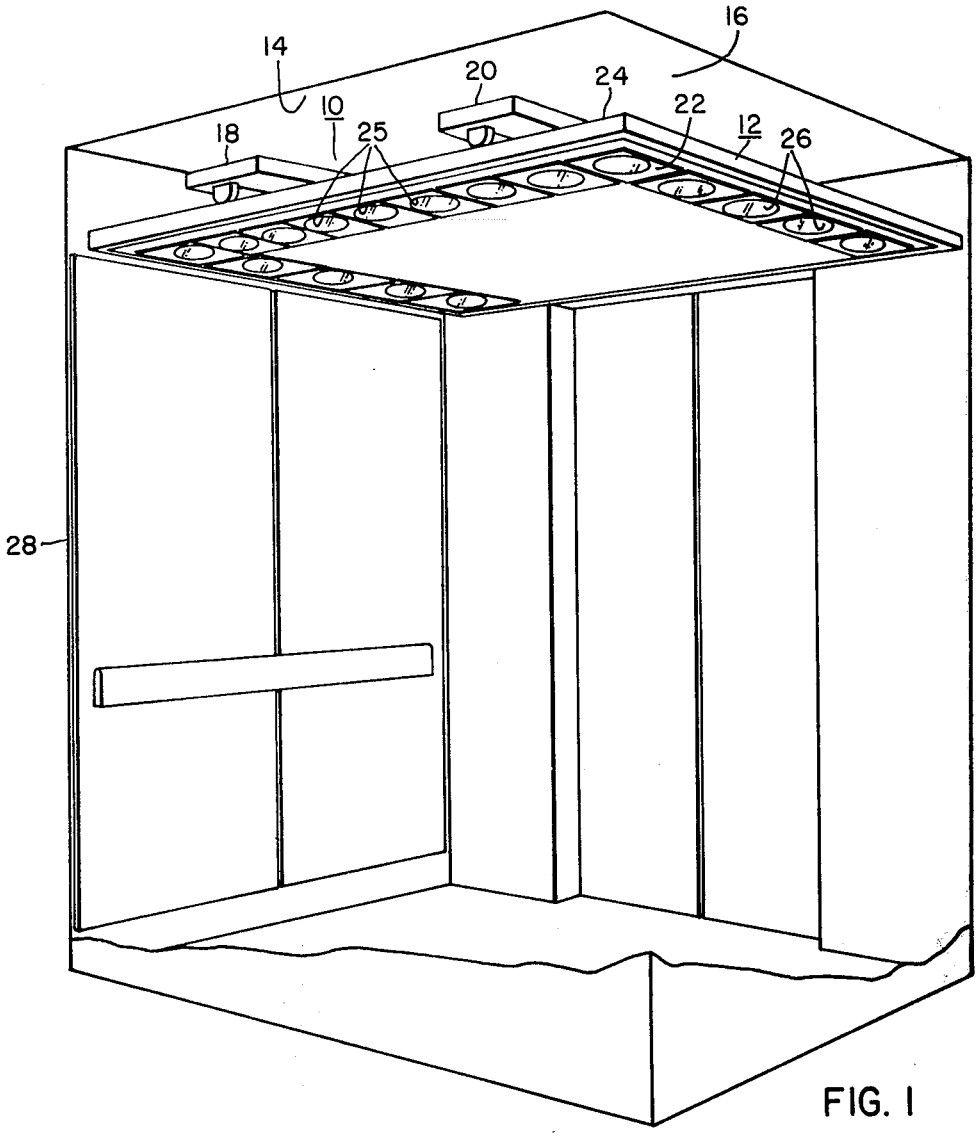
FIG. 1 is a perspective view of a decorative, drop ceiling structure which may be constructed according to the teachings of the invention.

Referring now to the drawings, and to FIG. 1 in particular, there is shown a decorative, drop ceiling structure 10 of the type which may be constructed according to the teachings of the invention. Drop ceiling structure 10 includes a panel 12 disposed in spaced relation below the normal ceiling 14, to form a space or plenum 16 in which one or more lighting fixtures of any suitable type may be mounted, such as the fluorescent lighting fixtures 18 and 20 illustrated.

Panel 12 will usually be formed of an opaque material, such as wood or a laminated plastic. Panel 12 has first and second major flat or planar, parallel opposed surfaces 22 and 24, respectively, with surface 22 facing the area to be illuminated, and surface 24 facing the source of light.

The thickness dimension of panel 12, measured between surfaces 22 and 24, will depend upon the material and the desired strength of the panel. When a drop ceiling of wood is used, a typical thickness of the wood panel is 0.875 inch.

Panel 12 has a plurality of openings 25 therein which extend between its first and second surfaces 22 and 24, respectively. Any number of openings may be used. They may be located in any desired placement pattern or design, and each opening may have a round, square, or other non-round configuration. Lenses 26 formed of a light transmissive material are mounted in each of the openings 25. Each lens 26 is formed to the shape of the associated opening, and it is dimensioned to fit its associated opening 25 with a sliding fit.

Ceiling structure 10 is illustrated illuminating the interior of an elevator cab 28, but it is to be understood the invention is applicable to any area to be illuminated by a drop ceiling having a plurality of lenses 26 mounted therein for transmission of light from a light source to this area.

Figure 2:
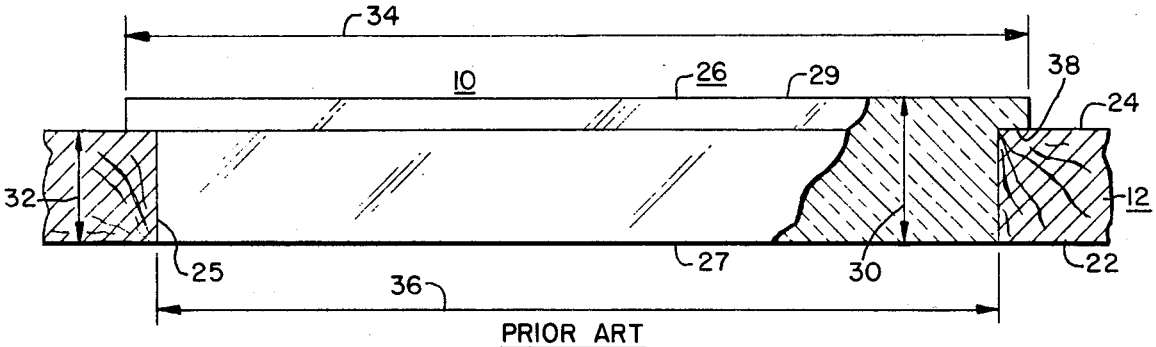
PRIOR ART FIG. 2
FIG. 2 is a fragmentary elevational view, partially in section, of a drop ceiling and associated lens, constructed according to the teachings of the prior art.

FIG. 2 is a fragmentary elevational view, partially in section, of the drop ceiling structure 10 shown in FIG. 1 constructed according to the teachings of the prior art. The lens 26 has first and second major opposed surfaces 27 and 29, which in a preferred embodiment are both flat or planar surfaces. Lens 26 has a thickness dimension 30 between the major surfaces which is selected to exceed the thickness dimension 32 of the panel 12. For example, if the panel 12 is 0.875 inch thick, the lens 26 may be 1.125 inches thick. When the opening 25 is round, the lens 26 has a first diameter 34 which exceeds the diameter of the opening 25. The first diameter 34 steps sharply inward to a second smaller diameter 36, forming a flange or shoulder 38. The second diameter 36 is slightly less than the diameter of the opening 25, so that the portion of the lens 26 defined by the second diameter 36 will freely but snugly slide into the opening 25.

The portion of lens 26 which includes the second diameter portion 36 has a dimension measured in the direction of the lens thickness dimension 30, which is the same as the thickness dimension 32 of the panel 12. This results in the first surface 27 of the lens 26 being co-planar with the lower surface 22 of the panel 12.

In a preferred embodiment of the invention, the lens 26 is formed of a clear polycarbonate resin. Polycarbonate resins are available in the form of an extrusion for the sizes and configurations required. The dimensional tolerances, however, increase with the increasing thickness of the material. This complicates and increases the cost of machining the lens.

The present invention enables the lens thickness dimension to be selected and standardized, without regard to the thickness dimension of the drop ceiling panel. Further, as long as the lens is thick enough to provide the required light dispersion, the thickness dimension may be selected with both the manufacturing tolerance range and piece cost in mind. For example, a very economical thickness for extruded polycarbonate resin is 0.5 inch. The manufacturing tolerances on this readily available stock size are very good, and the light dispersion through a 0.5 inch thick lens is adequate for use as a lens in a drop ceiling.

Figure 3:
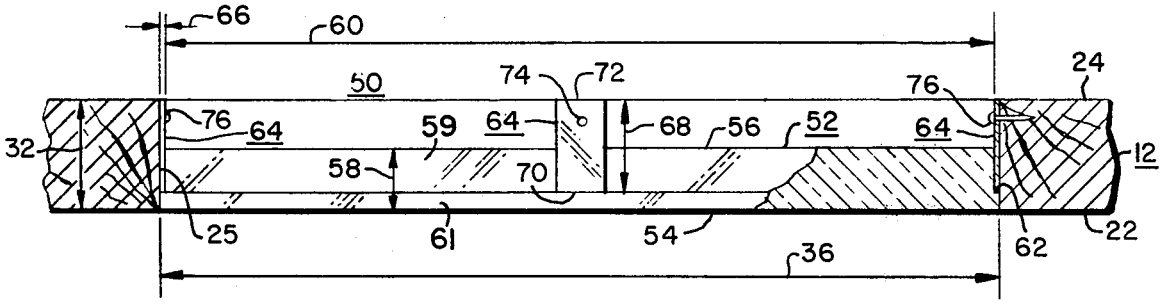
FIG. 3 is a fragmentary elevational view, partially in section, of a drop ceiling and associated lens, constructed according to the teachings of the invention.

FIG. 3 is a fragmentary elevational view, partially in section, of a drop ceiling structure 50 constructed according to the teachings of the invention. The drop ceiling structure 50 may be used for the drop ceiling structure 10 shown in FIG. 1. The drop panel 12 may be the same as the panel 12 shown in FIGS. 1 and 2, and is given the same reference numerals.

In this embodiment, the drop ceiling structure 50 includes a lens 52 having first and second major opposed, parallel surfaces 54 and 56, respectively, and a thickness dimension 58 measured perpendicular to its major surfaces which is less than the thickness dimension 32 of the panel 12. Lens 52 may be formed of a clear polycarbonate resin, with a suitable thickness dimension being 0.5 inch. The configuration and dimensions of the lens 52 are selected to be substantially the same as the configuration and dimensions of the opening 25. When the opening 25 is round, the diameter 36 of the lens is selected to be a sliding fit with the opening.

Starting about 0.120 inch from the first surface 54 of the lens 52, the outer periphery of the lens is machined to a depth of about 0.030 inch, forming a surface 60 having a second diameter 60 which is less than the surface 61 associated with the original or first diameter 36. The surface 59 associated with the smaller second diameter 60 extends to the second surface 56 of the lens. The transition between the first and second diameters 36 and 60 forms a step or shoulder 62 on the outer periphery of the lens.

A plurality of rectangularly shaped strips or tabs 64 formed of a clear plastic material are adhesively joined to the outer periphery of lens 52. The strips 64 have a thickness dimension 66 which is substantially the same as the depth of the machining which created the smaller or second diameter surface 59, such as 0.030 inch. They have a length dimension 68 selected such that when an end 70 of the strip is butted against shoulder 62, the opposite end 72 is in substantially the same plane as the second major surface 24 of panel 12. The strips 64 are uniformly spaced about the periphery of the lens, such as 90° apart when four are used, or 120° apart when three are used. They are joined to the surface of the second diameter 60 of lens 52 with a suitable adhesive. The strips 64 are constructed of a suitable plastic material, such as a clear polycarbonate. The strips 64 each have a small opening 74 formed therein which is spaced from end 72 by a suitable dimension, such as about 0.20 inch, for receiving a suitable fastener device, such as a nail 76. A screw may also be used.

The lens 52 with the strips 64 joined thereto is inserted into a suitable opening 25 in the drop ceiling or panel 12, with the first surface 54 of the lens flush with the first surface 22 of the panel 12. Nails 76 are inserted through openings 74 and driven into the panel 12 to firmly secure the lens within the opening 25.

The collar formed about the outer periphery of the lens by the larger diameter 36 gives the lens the appearance, when installed in opening 25, of being the same thickness as the larger thickness dimension 32 of the panel 12. It also gives the appearance of being the same diameter as the opening across the complete thickness dimension 58 of the lens 74. The fastening means, being in the form of a clear plastic strip which is adhesively joined to the lens, is not apparent to the eye when the lens in viewed from the illuminated area below. The completely recessed structural arrangement set forth in FIG. 3 is a preferred embodiment of the invention, especially when the drop ceiling is used in an elevator cab. It eliminates obstructions across the top surface of the panel 12 and facilitates the removal of an exit panel which may be located in the drop ceiling.

In the preferred embodiment of the invention, the length 68 of the strips 64 is selected such that the strips do not extend past the plane of the second surface 24 of the panel.

Figure 4:
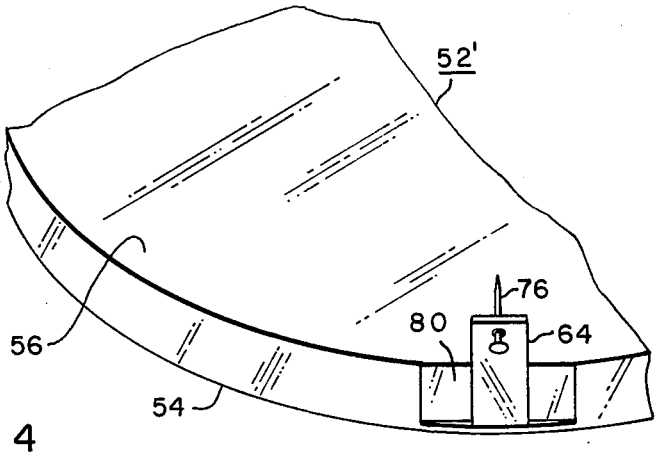
FIG. 4 is a fragmentary perspective view of a lens constructed according to another embodiment of the invention.

FIG. 4 is a fragmentary perspective view of a lens 52', which is similar to the lens 52 shown in FIG. 3, except the arrangement for providing space for mounting the strips 64 is modified. Instead of uniformly machining the periphery of the lens to provide a space for the strips, as in the FIG. 3 embodiment, the periphery is machined only at the locations which are to accommodate the strips. As illustrated in FIG. 4, a flat surface 80 may be provided at spaced locations about the lens. As in the embodiment of FIG. 3, the machining starts a predetermined dimension away from surface 54 and it extends to surface 56. The depth of the "flat" is selected to accommodate the thickness dimension of the strip 76.

Figure 5:
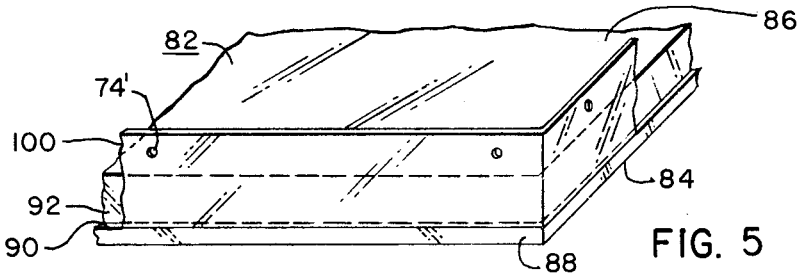
FIG. 5 is a fragmentary perspective view of a non-round lens constructed according to an embodiment of the invention.

The lens 26 in FIG. 1 is illustrated as being round. The lens may also be non-round of any desired configuration. FIG. 5 is a perspective view of a lens 82 having a non-round configuration, such as rectangular or square. Lens 82 has first and second major opposed, parallel surfaces 84 and 86, respectively. Space for fastener means 100 is provided by machining the outer periphery, starting a predetermined dimension from surface 84 and extending to surface 86. This results in a collar 88 which snugly fits an opening in an associated drop ceiling panel, a shoulder 90 against which the fastener means 100 is placed, and a surface 92 against which the fastener means is glued. The embodiment of FIG. 3 may also be applied to the non-round embodiment of FIG. 5.

Figure 6:
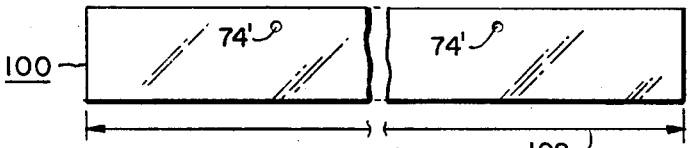
FIGS. 6 and 7 are elevational and end views, respectively, of a light transmissive fastener constructed according to another embodiment of the invention.
Figure 7:
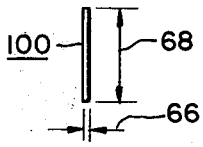

FIGS. 6 and 7 are front and end elevational views, respectively, of the fastener means 100 shown in FIG. 5. Fastener means 100 is a single, elongated strip of clear plastic, such as a polycarbonate resin. It may be used to mount the lens 82 of the FIG. 5 embodiment in panel 12, and it may also be used to mount lens 52 of the FIG. 3 embodiment in panel 12. Strip 100, which has a thickness dimension 66 and a height dimension 68 the same as strip 64 of the FIG. 3 embodiment, has a length dimension 102 equal to the circumference of the lens. In other words, if the lens is round, as in the FIG. 3 embodiment, the first or larger diameter of lens 52 is D, and the second or smaller diameter is D-2X, the strip 100 would have a thickness dimension equal to X and a length dimension equal to $\pi$(D-2X). If the lens is rectangular, as in the FIG. 5 embodiment, the strip 100 would have a thickness dimension of X and a length dimension equal to the length of the sides of lens 82 adjacent to the surface 92. A plurality of openings 74' are formed in strip 100 for receiving fastener devices, such as the nails 76 shown in FIG. 3.

Figure 8:
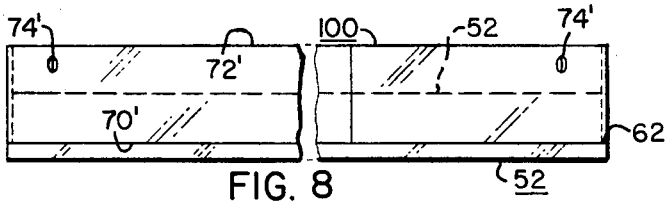
FIG. 8 is an elevational view illustrating the fastener of FIGS. 6 and 7 in combination with a lens, constructed according to the teachings of the invention.

FIG. 8 illustrates strip 100 assembled with the round lens 52. The strip 100 is wrapped about the periphery of lens 52 and fastened thereto with a suitable adhesive. Similar to the FIG. 3 embodiment, the lower edge 70' of strip 100 is butted against shoulder 62, with the top edge 72' preferably being flush with the top surface 24 of panel 12 when it is assembled therewith.

What we claim is:

1. A decorative drop ceiling, comprising:

a source of light;

a panel disposed between said source of light and an area to be illuminated;

said panel having a predetermined thickness dimension between first and second surfaces which face said area to be illuminated, and said source of light, respectively;

said panel defining at least one opening having a surface which extends between said first and second surfaces, with the opening having a predetermined configuration and dimensions;

a light transmissive lens in said at least one opening having first and second surfaces which face said area to be illuminated and said source of light, respectively, with the first surface of said lens being substantially co-planar with the first surface of said panel;

said lens having a thickness dimension between its first and second surfaces which is less than the thickness dimension of said panel;

the first surface of said lens having substantially the same configuration and dimensions as said opening;

the outer periphery of said lens being recessed, starting a predetermined dimension from the first surface of the lens and extending to the second surface, to provide a first outer surface which snugly fits the opening in said panel, and a second outer surface which is spaced from the surface of the opening to provide a predetermined space between the lens and panel;

and fastener means in said predetermined space which secure the lens in the opening;

said fastener means including light transmissive means having a first portion in said predetermined space, and a second portion which extends out of said space, adjacent to the surface of the opening, means joining said first portion to the second outer surface of said lens, and means fixing said second portion to the surface of the opening in the panel.

2. The ceiling of claim 1 wherein the panel defines a plurality of additional openings, and including a lens in each of said additional openings, with each additional lens being similar to the lens mounted in the at least one opening.

3. The ceiling of claim 1 wherein the at least one opening and lens have a like non-round configuration.

4. The ceiling of claim 1 wherein the at least one opening and lens each have a round configuration.

5. The ceiling of claim 1 wherein the lens is formed of a polycarbonate resin.

6. The ceiling of claim 1 wherein the light transmissive means has its first portion adhesively fastened to the lens and its second portion, which extends above the second surface of the lens, mechanically fastened to the surface of the opening in the panel.

7. The ceiling of claim 1 wherein the opening and lens have round configurations, with the first outer surface of the lens having a first diameter adjacent to its first surface, and the second outer surface having a second diameter, smaller than the first diameter, adjacent to its second surface, with the second diameter providing the predetermined space for the fastener means.

8. A decorative drop ceiling, comprising:

a source of light;

a panel disposed between said source of light and an area to be illuminated;

said panel having a predetermined thickness dimension between first and second surfaces which face said area to be illuminated, and said source of light, respectively;

said panel defining at least one opening which extends between the first and second surfaces, with the opening having a round configuration and predetermined dimensions;

a light transmissive lens in said at least one round opening having a thickness dimension between first and second surfaces which face said area to be illuminated and said source of light, respectively, with the first surface of said lens being substantially co-planar with the first surface of said panel;

the first surface of said lens having substantially the same round configuration and dimensions as said opening;

said panel having a thickness dimension which exceeds the thickness dimension of said lens;

said lens having a first diameter D adjacent to its first surface, a second diameter D-2X adjacent to its second surface, and a shoulder at the transition, to provide a recess in its outer periphery which starts a predetermined dimension from the first surface of the lens and extends to the second surface, to provide a predetermined space between the lens and panel;

and fastener means in said space which secure the lens in the opening;

said fastener means including a strip of light transmissive material having a thickness dimension X, a length dimension $\pi$(D-2X), and a height which exceeds the dimension from the shoulder to the second surface of the lens, said strip being wrapped about and adhesively joined to the outer periphery of the lens associated with the second diameter, and means joining the portion of the strip which extends above the second surface of the lens to the surface of the opening in the panel.

9. A decorative drop ceiling, comprising:

a source of light;

a panel disposed between said source of light and an area to be illuminated;

said panel having a predetermined thickness dimension between first and second surfaces which face said area to be illuminated, and said source of light, respectively;

said panel defining at least one opening which extends between the first and second surfaces, with the opening having a non-round configuration and predetermined dimensions;

a light transmissive lens in said at least one opening having a thickness dimension between first and second surfaces which face said area to be illuminated and said source of light, respectively, with the first surface of said lens being substantially co-planar with the first surface of said panel;

the first surface of said lens having substantially the same non-round configuration and dimensions as said opening;

said panel having a thickness diemension which exceeds the thickness dimension of the lens;

said lens having a first periphery adjacent to its first surface, a second periphery, smaller than the first, adjacent to its second surface, and a shoulder at the transition between said first and second peripheries, to provide a recess in its outer periphery which starts a predetermined dimension from the first surface of the lens and extends to the second surface, to provide a predetermined space between the lens and panel;

and fastener means in said space which secure the lens in the opening;

said fastener means including a strip of light transmissive material having a height which exceeds the dimension from the shoulder to the second surface of the lens, said strip being wrapped about and adhesively joined to the second periphery of the lens, and means joining the portion of the strip which extends above the second surface of the lens to the surface of the opening in the panel.

* * * * *